US006014113A

United States Patent [19]

Orchard et al.

[11] Patent Number: 6,014,113

[45] Date of Patent: Jan. 11, 2000

[54] ANTENNA ASSEMBLY COMPRISING CIRCUIT UNIT AND SHIELD MEMBERS

[75] Inventors: Lee Orchard, Surrey, United Kingdom; David Hicks, Stockholm, Sweden; Brian James Davidson, Surrey, United Kingdom

[73] Assignee: Nokia Mobile Phones Limited, Finland

[21] Appl. No.: 08/995,133

[22] Filed: Dec. 19, 1997

[30] Foreign Application Priority Data

| | | | |
|---|---|---|---|
| Dec. 23, 1996 | [GB] | United Kingdom | 9626737 |
| Jan. 20, 1997 | [GB] | United Kingdom | 9701064 |

[51] Int. Cl.[7] ..... H01Q 1/52

[52] U.S. Cl. ..... 343/841; 343/702

[58] Field of Search ..... 343/700 MS, 702, 343/841, 846

[56] References Cited

U.S. PATENT DOCUMENTS

| | | | |
|---|---|---|---|
| 4,998,078 | 3/1991 | Hulkko | 333/109 |
| 5,268,699 | 12/1993 | Laute et al. | 343/702 |
| 5,341,149 | 8/1994 | Valimaa et al. | 343/895 |
| 5,394,160 | 2/1995 | Iwasaki et al. | 343/702 |
| 5,483,678 | 1/1996 | Abe | 455/80 |
| 5,550,554 | 8/1996 | Erkocevic | 343/702 |
| 5,561,439 | 10/1996 | Moilanen | 343/846 |
| 5,585,806 | 12/1996 | Ogino et al. | 343/700 MS |
| 5,627,550 | 5/1997 | Sanad | 343/700 |
| 5,657,028 | 8/1997 | Sanad | 343/700 |
| 5,668,561 | 9/1997 | Perrotta et al. | 343/702 |
| 5,680,144 | 10/1997 | Sanad | 343/700 |

FOREIGN PATENT DOCUMENTS

| | | |
|---|---|---|
| 0680112 A2 | 11/1995 | European Pat. Off. . |
| 1403829 | 8/1975 | United Kingdom . |
| WO 94/26038 | 11/1994 | WIPO . |

*Primary Examiner*—Don Wong
*Assistant Examiner*—Tan Ho
*Attorney, Agent, or Firm*—Perman & Green, LLP

[57] ABSTRACT

An antenna assembly comprising: an antenna; a circuit unit; and a device cover for connection between the antenna and the circuit unit to electrically couple the antenna to the circuit unit.

9 Claims, 5 Drawing Sheets

ANTENNA ASSEMBLY COMPRISING CIRCUIT UNIT AND SHIELD MEMBERS

BACKGROUND OF THE INVENTION

This invention relates to an antenna assembly.

Antennas are used in many electronic products. There is a need to streamline and reduce the cost of assembly of antennas, especially in high volume consumer products such as radio telephones. An antenna is typically soldered or screwed into place. This is time-consuming and requires special equipment. Then electrical feed and ground connections to the antenna are typically provided separately, in a similar way, requiring further manufacturing steps and connecting materials. One aim is therefore to simplify the connection of an antenna, preferably also reducing the number of components required.

SUMMARY OF THE INVENTION

According to the present invention there is provided an antenna assembly comprising: an antenna; a circuit unit; and a device cover for connection between the antenna and the circuit unit to electrically couple the antenna to the circuit unit.

The device cover is suitably a shield, preferably a shield against electromagnetic radiation, and most preferably a shield for an electronic device. The device cover preferably performs a shielding function in addition to providing a connection to the antenna.

The device cover is preferably a cover for an electronic device, for example an integrated circuit, most preferably for a single electronic device. The device cover preferably covers one or more devices that are connected directly or near (in terms of an electronic circuit) to the antenna and/or that form part(s) of a radio transceiver circuit, e.g. a synthesiser.

The device cover preferably comprises electrically conductive material. That electrically conductive material preferably at least defines a track for connecting the antenna to the circuit unit. That electrically conductive material may be in the form of a coating for the cover, or the cover may consist (or consist substantially) of conductive material. The conductive mater ial may be metallic. The conductive material may preferably aid a shielding function of the cover.

The device cover may be connected to the antenna and/or the circuit unit. The device cover and/or the antenna may comprise means for connecting the two together, for example by heat staking. The device cover and/or the circuit unit may comprise means for connecting the two together, for example by soldering. The device cover may be in (at least) two mutually detachable parts, one connected to the antenna and the other connected to the circuit unit. The two parts may be releasably connectable to each other. One of the parts (preferably that connected to the antenna) may take the form of a lid which can be removed from the other to allow access to a device covered by the device cover. The other part may provide one or more walls perpendicular to the "lid" when the two are engaged/connected.

The device cover is suitably electrically coupled/connected to the antenna and to a region of the circuit unit. The device cover suitably provides an electrical coupling/connection path between the antenna and the circuit unit. Preferably the device cover includes an electrically conductive portion. Preferably that portion is in contact with a first circuit element of the antenna (for example a ground region or ground plane or surface of the antenna) and with a first antenna connection region of the circuit unit. More than one member of the device cover may provide the said electrically conductive portion. The first antenna connection region is preferably a ground region or an electrical feed region. The device cover is suitably a cover (or part of a cover) for electronic circuitry. The device cover is preferably a shield (or part of a shield) against electromagnetic radiation, most preferably radio frequency (RF) radiation. The device cover may have two parts, one fast with the circuit unit and/or one fast with the antenna. One or both of the parts may include side walls for surrounding the device. One or both of the parts may include a lid for covering the device. Preferably the lid is in contact with a surface of the antenna. One of the parts may be capable of engaging the other part so as to hold the antenna (when it is fixed to one of the parts) in engagement with the circuit unit (when the unit is fixed to the other of the parts). One part may engage the other frictionally.

The circuit unit is preferably a circuit board, suitably a rigid circuit board. The circuit unit preferably provides interconnections between devices mounted on it, suitably including a device to be covered by the device cover. The device cover preferably provides a ground connection to the antenna, coupling the antenna to a ground region of the circuit unit. The circuit unit may be a circuit board or a printed circuit board (PCB) with or without other components such as metallisation and electronic devices. The circuit unit suitably comprises electrically conductive material which preferably defines conductive tracks for interconnection of electronic devices. The conductive material preferably at least defines a track for coupling (most preferably directly—without intervening components) the antenna to a device covered by the device cover.

The antenna assembly is preferably part of a radio telephone.

There is preferably a deformable electrical coupler associated with at least one of the antenna and the circuit unit for deformable compression between the antenna and the circuit unit, when the antenna and the circuit unit are brought together, to provide a second electrical coupling between the antenna and the circuit unit. This second electrical coupling preferably provides the antenna feed. The device cover preferably constitutes a retaining means for retaining the antenna in physical connection to the circuit unit when the antenna and the circuit unit are brought together. The retaining means is preferably a retainer.

Suitably the said deformable coupler is resiliently deformable, preferably resiliently compressible and most preferably resiliently compressible along an axis. Preferably that axis is perpendicular to a major plane of the antenna and/or a major plane of the circuit unit. The coupler is preferably an electrically conductive element. The coupler is preferably elongate. At least part of the coupler is preferably fast with the antenna. It preferably extends through the antenna (e.g. from one surface of the antenna to the opposite surface) to allow a second circuit element of the antenna furthest from the circuit unit (for example the radiating surface) to be coupled to the circuit unit. When the antenna and the circuit unit are brought together the coupler preferably makes contact with a second antenna connection region of the circuit unit. Preferably the second antenna connection region is for providing the electrical feed to the antenna or for grounding the antenna.

Preferably the antenna is substantially planar. Preferably the antenna is a planar antenna. Preferably the antenna is a PIFA (planar inverted F antenna) antenna.

According to the present invention from a second aspect there is provided a method of connecting an antenna to a circuit unit, the method comprising: deforming at least part of the antenna so as to connect the antenna to a first retaining member; and resiliently engaging the first retaining member with a second retaining member associated with the circuit unit.

The deformation is preferably conducted under the influence of heat. The antenna is preferably heat staked to the first retaining member, most preferably by the deformation of a projection of the antenna following insertion of the projection through a corresponding recess or hole in the first retaining member. Preferably, the first and second retaining members, when assembled together, constitute a device cover and or shield.

BRIEF DESCRIPTION OF THE DRAWINGS

The present invention will now be described by way of example, with reference to the accompanying drawings, in which.

DETAILED DESCRIPTION OF THE INVENTION

Figure 8:
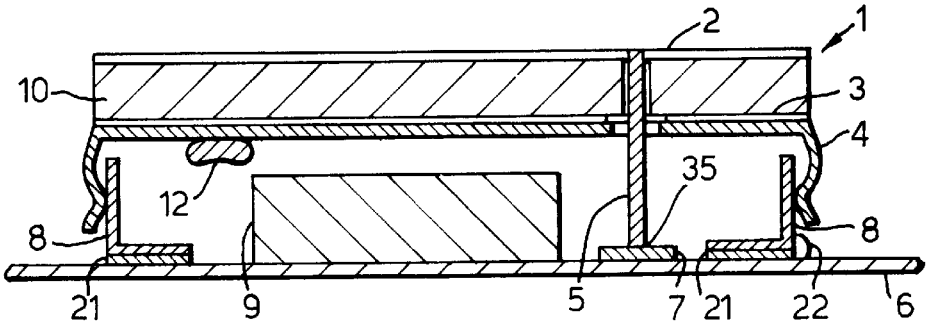
FIG. 8 is a cross-sectional view of a circuit board with an antenna and a device cover installed.

FIG. 8 shows an antenna 1 having radiating 2 and ground 3 regions of electrically conductive material. The antenna is fixed to device cover 4 which is in contact with the ground region 3. The antenna has a sprung pin 5 which is in contact with the radiating region 2. Underlying the antenna 1 is a circuit board 6 which has an electrical feed pad 7, connected to circuitry intended to provide an electrical feed to the antenna, and a lower cover member 8 which is coupled to ground of the circuit board. The device cover 4 and the lower cover member 8 are electrically conductive. When the antenna 1 (together with the device cover 4) and the circuit unit are brought together the device cover 4 engages the lower cover member 8, holding the antenna to the circuit board 6 and making a ground connection between the circuit board and the antenna. At the same time the sprung pin 5 is compressed between the antenna 1 and the feed pad 7, making an electrical feed connection to the antenna 1. The device cover 4 and the lower cover member 8 act as a shield for electronic components 9 contained within them.

The antenna 1 is shown in detail in FIGS. 1 and 2*a* to 2*d*. The antenna is a plate antenna comprising a core 10 moulded of non-conductive thermoplastic material (such as the plastics material Ultem 2300) selectively plated with electrically conductive material (for example with successive layers of copper, nickel and gold). The core has two holes 11*a*, 11*b* running through it from one major surface to the other. Two cylindrical pegs 12 integral with the core extend from major surface 13 of the core. For orientation purposes one corner of the antenna is chamfered. Typically, the dimensions of the antenna may be 16 mm×35.5 mm×3.2 mm.

Substantial areas of both major surfaces 13, 14 of the core are plated. The plating on surface 13 defines the ground plane of the antenna. All of that surface is plated apart from an annulus 11*c* around through-hole 11*b* (the region shaded in FIG. 2*d*). The pegs 12 are uncoated. The plating on major surface 14 defines the radiating surface of the antenna. All of that surface is plated apart from slots 15 designed to increase the electrical length of the antenna for tuning purposes. The edge surfaces of the core are unplated but the interiors of through-holes 11*a*, 11*b* are plated, so the ground plane and the radiating surface are connected electrically together via the plating of through-hole 11*a*.

Figure 1:
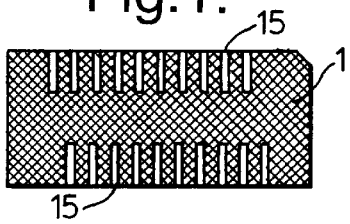
FIG. 1 is a top view of an antenna, the cross hatching indicating electrically conductive plating.
Figure 2A:
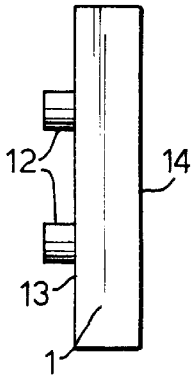
FIG. 2*a* is an end view of the antenna of FIG. 1.
Figure 2B:
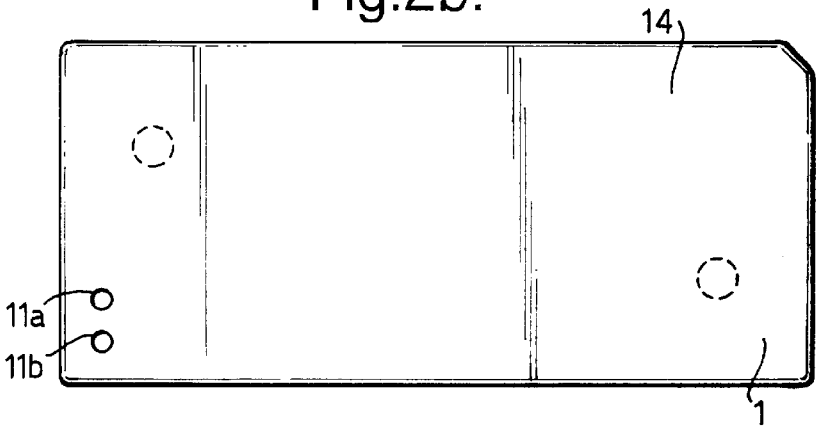
FIG. 2*b* is a top view of the antenna of FIG. 1.
Figure 2C:
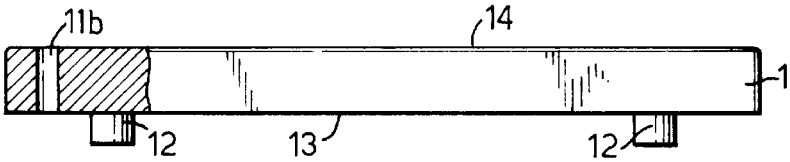
FIG. 2*c* is a side view of the antenna of FIG. 1, including a partial cross-section on the line B—B in FIG. 2*b;*
Figure 2D:
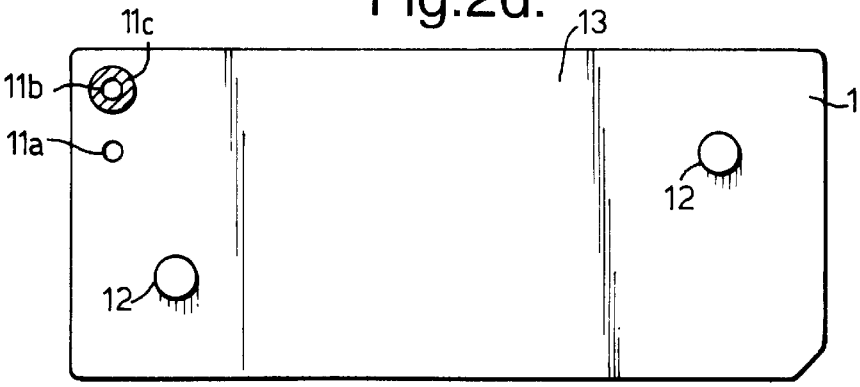
FIG. 2*d* is a bottom view of the antenna of FIG. 1, the shaded area indicating a region free from electrically conductive plating.
Figure 3A:
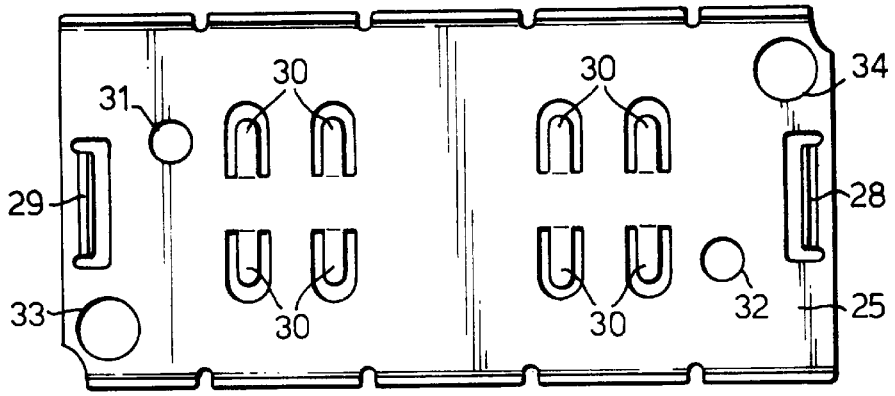
FIG. 3*a* is a top view of a device cover.
Figure 3B:
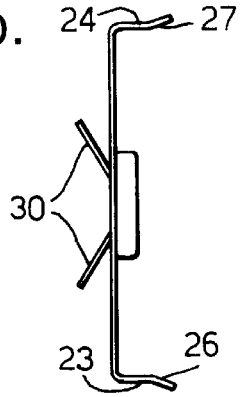
FIG. 3*b* is an end view of the device cover of FIG. 3*a;*
Figure 3C:
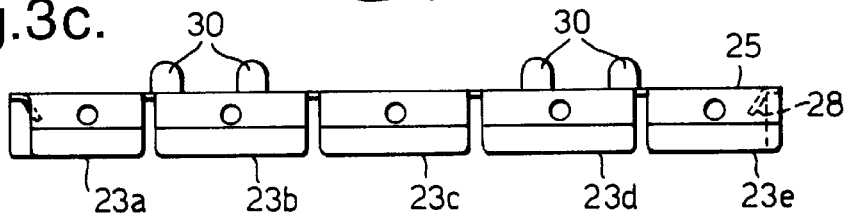
FIG. 3*c* is a side view of the device cover of FIG. 3*a;*
Figure 3D:
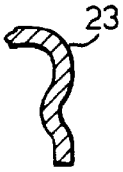
FIG. 3*d* is a cross-section on line A—A in FIG. 3*c;*
Figure 3E:
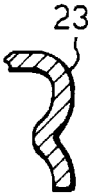
FIG. 3*e* is a cross-section on lines B—B in FIG. 3*c;*
Figure 3F:
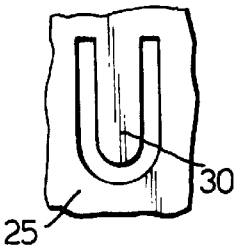
FIG. 3*f* is a detail around the finger marked C in FIG. 3*a;*
Figure 3G:
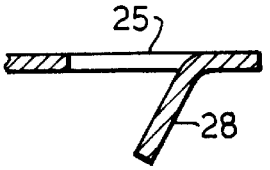
FIG. 3*g* is a cross-section on line D—D in FIG. 3*a;*
Figure 4:
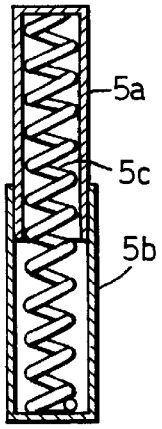
FIG. 4 is a cross-section of a sprung connector pin.
Figure 5A:
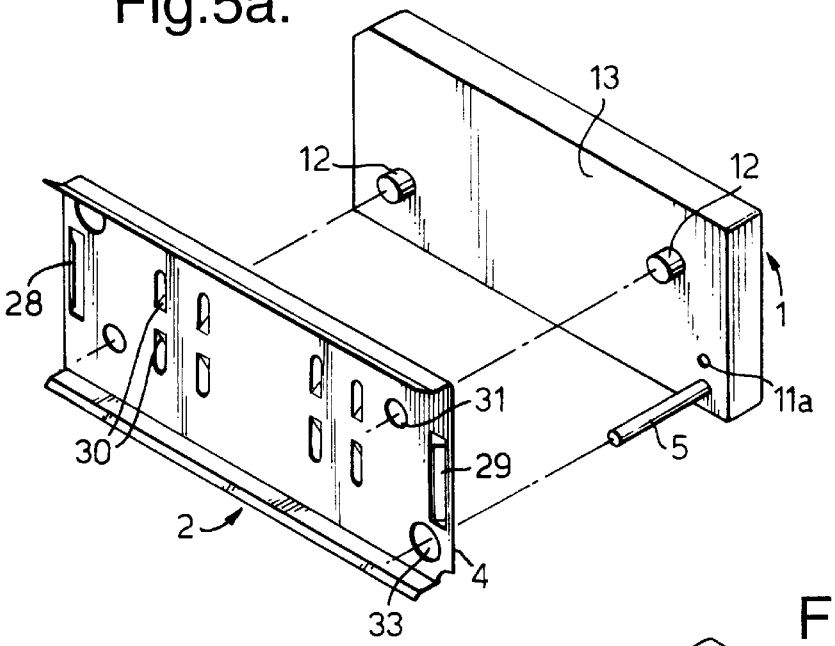
FIG. 5*a* is a view of the antenna of FIG. 1 (together with the pin of FIG. 4) and the device cover of FIG. 3*a* prior to assembly.
Figure 5B:
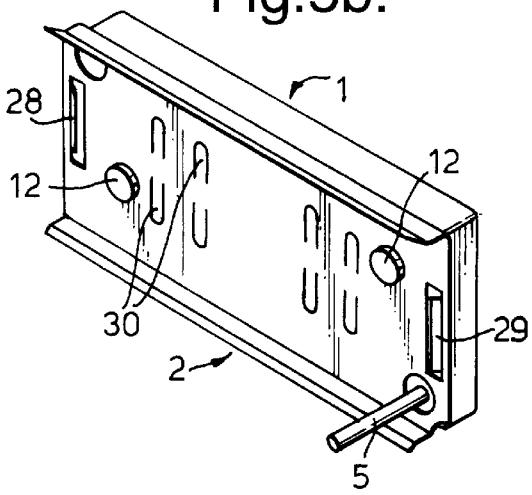
FIG. 5*b* is a view of the same parts after having been assembled together.

The connector pin 5 is shown in detail in FIG. 4. It comprises two concentric cylindrical metal tubes 5*a*, 5*b* arranged so that one can telescope inside the other. A coil spring 5*c* concentric with the tubes biases the extreme ends of the pin apart. The extreme ends of the pins are closed. The pin is coated with gold for good electrical conductivity.

The device cover 4 and the lower cover 8 form an electromagnetic RF shield for the synthesiser 9*a* of the transceiver circuit of a radio telephone. The members of the shield are made of metal plate and could be manufactured by die stamping. Alternatively they could be made of plastic coated all over or selectively with electrically conductive material.

The lower cover 8, which constitutes the lower member of the RF shield, has a planar frame 16 and four walls 17, 18, 19, 20 which are folded upwards from the frame. When the lower cover is installed on the circuit board 6 it is installed around the expected location of the synthesiser 9a so that the four walls 17–20 surround the synthesiser once manufacture is complete. The lower cover 16 is grounded. This may be done by means of a grounding wire; or preferably the frame 16 makes contact with a ground region 21 on the circuit board, and for a better connection is also soldered to that region (e.g. at 22). The frame may be physically fixed to the circuit board by numerous methods, such as soldering and/or the bending of tabs passed through holes in the circuit board.

The upper cover 4 (shown in detail in FIGS. 3*a* to 3*g*), which constitutes the upper member of the RF shield, has a generally planar top section 25. Parallel flanges 23, 24, each of which comprises five sub-flanges (e.g. 23*a*–*e*) are folded down from the side edges of the top section and are spaced so as to be able to engage the outside surfaces of walls 18, 20 of the lower cover. The flanges are resiliently deformable with respect to the top section and converge slightly so as to be able to pinch and grip the walls 18, 20 when the upper cover is pushed on to the lower cover. The distal ends 26, 27 of the flanges are flared so as to aid location of the flanges around the walls 18, 20. Location lugs 28, 29 are folded down from the top section and are spaced so as to fit neatly between walls 17, 19 and thus assist in correct locating of the upper cover on the lower cover.

The top section 21 of the cover 4 is dimensioned to match the antenna. Eight fingers 30 are directed upwards from the top section. The inclination of the fingers is resiliently deformable so that even if the fingers are pressed so as to lie in the plane of the top section they will exert a force upwards from the plane.

The cover 4 has four holes 31, 32, 33, 34 through the top section. Holes 31, 32 are spaced and dimensioned to correspond to the spacing and dimensions of the pegs 12, and located so that the pegs can fit through those holes with the sides of the antenna 1 generally flush with the sides of the cover 4. Both the pegs 12 and the holes 31, 32 are arranged symmetrically so that the device cover 4 and the antenna 1 can be fitted together successfully in two orientations (one rotated by 180 degrees with respect to the other), making the operation of assembly easier. Holes 33, 34 are to allow the sprung pin 5 to pass through the device cover 4. (Two holes are provided so that this can be done with the cover in either orientation relative to the antenna). The diameter of the holes 33, 34 is larger than that of the sprung pin 5 to ensure that the cover 4 and the pin 5 do not make contact (shorting the antenna) or even otherwise couple together undesirably.

The operation of assembly of the shield and antenna will now be described.

First, the sprung pin 5 is inserted in hole 11*b* in the antenna core 10 so that it is lodged in place with one extreme end of the pin flush with the upper surface 14 of the antenna and the other end of the pin projecting from the ground plane of the antenna generally perpendicularly to the ground plane. The diameter of the hole 11*b* matches the exterior diameter of the pin so that the pin can make an interference fit in the hole. To assist this further the hole 11*b* is tapered.

Next, the antenna 1 is married to the upper shield member 4 with the pegs 12 inserted through the holes 31, 32, the pin 5 inserted through one of the holes 33, 34, and the ground plane 3 of the antenna pressed against the cover so as to urge against the fingers 30. The urging of the fingers against the ground plane improves the electrical contact between the cover 4 and the ground plane. Ideally, the ground plane of the antenna is also in contact with the upper surface of the top plate 25 of the cover 4, so as to further improve the electrical connection between the two parts.

Figure 6:
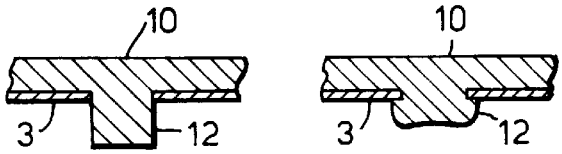
FIG. 6 is a cross-sectional view illustrating heat staking of the antenna to the device cover.
Figure 7:
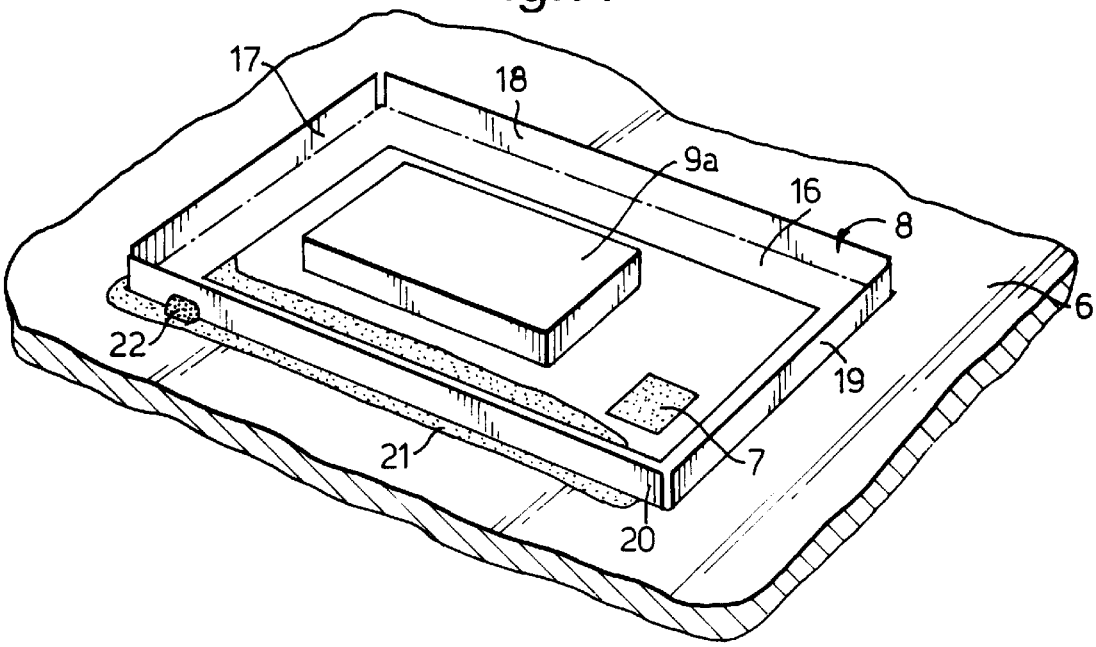
FIG. 7 is a partial view of a circuit board with installed components.

With the antenna and the cover 4 held together, a hot probe is forced against the tips of the pegs 12. The probe may itself hold the antenna and the cover together and hold the fingers 30 in compression. The probe softens the pegs and deforms them against the rear surface of the top section 25 of the cover 4 (see FIG. 6) to hold the antenna against the cover. The antenna 1 is thus heat staked to the cover 4. Alternative methods of deforming the pegs are impact staking and softening of the pegs using ultrasonic radiation.

Once the synthesiser 9*a* is connected to the circuit board 6, and the lower shield member 8 is fixed around the synthesiser and connected to the ground of the circuit board, the upper shield member 4 together with the antenna is pressed into place on the lower shield member 8. The location lugs 28 help to guide the cover into place; the flanges 23, 24 slide and grip against the side walls 18, 20 and the distal end 35 of the spring pin 5 makes contact with and is pressed into contact with the feed pad 7 on the circuit board. Thus the feed and ground connections to the antenna are made substantially simultaneously, in one operation, as the cover is moved (conveniently in a generally straight line) towards the circuit board. The movement of the cover relative to the circuit board is suitably substantially along the axis of the pin 5, although for the purpose of wiping the contact zone between the tip of the pin and the feed zone of the circuit unit there may be off-axis movement of the cover/antenna unit too. The flanges 23, 24 must have sufficient inward bias that the friction between them and the walls 18, 20 is sufficient to resist the biasing force of the spring 5*c* of the connector 5. To help ensure that the cover 4 will not come loose from the lower member 8 by vibration or under the action of the spring 5*c* the walls 18, 20 may be shaped to positively engage the flanges so that the cover 4 clips into engagement with the lower member 8.

If the antenna or the synthesiser need to be accessed, serviced or tested the antenna can easily be removed and replaced, together with the synthesiser shield cover 4. It is advantageous for the device under the cover 4 to be part of the transceiver circuit because it is relatively convenient to connect it to the antenna.

Examples of other embodiments of the invention will now be described. The shield could consist substantially of only an upper member which engages, say, grounding pins on the circuit board. The upper shield member 4 may have flanges that engage every one of the side walls of the lower member 8. Extra retaining means (such as additional clips) may be used to hold the upper member 4 on the lower 8. Alternatively, no such means may be provided. The pin 5 could be provided on the circuit board, pointing upwards, instead of on the antenna.

Figure 9:
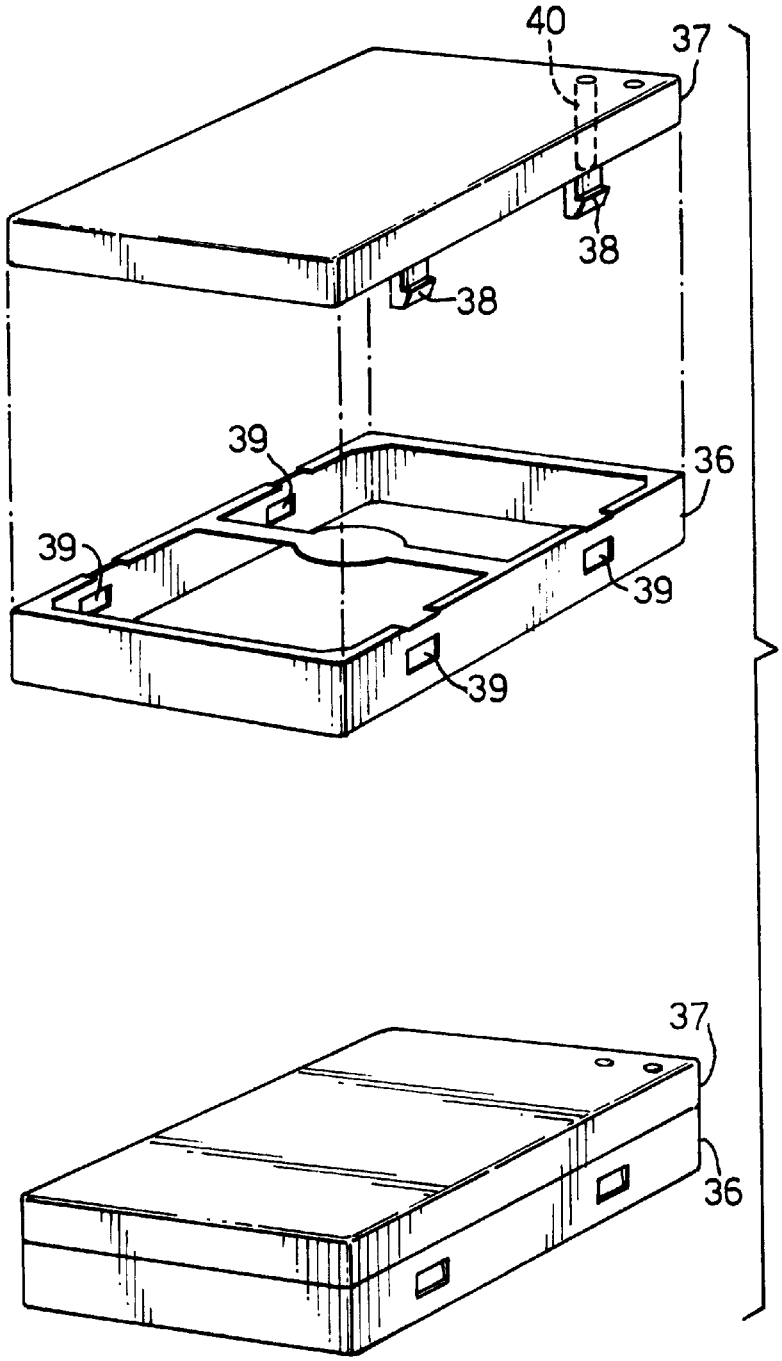
FIG. 9 shows an alternative embodiment of the cover.

FIG. 9 shows another embodiment of the antenna assembly. In this embodiment the shield consists of a shield unit 36 formed from metal. The antenna 37 has side clips 38 extending from its lower (ground plane) surface. Corresponding recesses 39 in the shield unit 36 accommodate the clips 38 allow the upper unit to be releasably but firmly engaged with the lower unit, with the metallisation of the ground plane held against the metal shield 36 to ground it effectively. The feed pin 40 of the antenna can then extend through the shield unit 36 to make contact with an antenna feed pad on an underlying circuit board.

The present invention may include any novel feature or combination of features disclosed herein either explicitly or implicitly or any generalisation thereof irrespective of whether or not it relates to the presently claimed invention or mitigates any or all of the problems addressed. In view of the foregoing description it will be evident to a person skilled in the art that various modifications may be made within the scope of the invention.

What is claimed is:

1. An antenna assembly comprising:

a cover for a shield, said cover comprising an antenna having a radiating region, and being pressure-attachable to a lower shield member;

said lower shield member comprising a circuit unit, and a pressure-connecting means which electrically couples the radiating region of said antenna to said circuit unit when said cover is pressure-attached to said lower shield member.

2. An antenna assembly according to claim 1 in which said pressure-connecting means is resiliently-deformable.

3. An antenna assembly according to claim 1 in which said pressure-connecting means is a pressure-biased spring pin.

4. An antenna assembly according to claim 1 in which said cover and said lower shield member are releasable-attached to each other.

5. An antenna assembly according to claim 4 in which said cover and said lower shield member are frictionally attached to each other.

6. An antenna assembly according to claim 1 in which said antenna and said cover are discrete parts which are fixedly attached to each other as a unit.

7. An antenna assembly according to claim 1 in which said antenna also comprises a ground region which is pressure-connected to ground via said lower shield member when the cover is pressured-attached to the lower shield member.

8. An antenna assembly according to claim 7 in which the cover comprising the antenna is provided with resiliently deformable conductive flanges which frictionally-engage a peripheral conductive shield wall on the lower shield member, connected to ground, to ground the ground region of the antenna when the cover and the lower shield member are pressure-attached to each other.

9. An antenna assembly according to claim 8 in which said conductive shield wall provides a shield for the circuit unit against electromagnetic radiation.

* * * * *